US006193065B1

(12) United States Patent
Salomone

(10) Patent No.: US 6,193,065 B1
(45) Date of Patent: Feb. 27, 2001

(54) SLIDE PRESENTATION KIT, SLIDE PRESENTATION SYSTEM AND METHOD OF ORGANIZING INFORMATION FOR A SLIDE PRESENTATION

(75) Inventor: Daniel Salomone, New York, NY (US)

(73) Assignee: Current Medical Directions, Inc., New York, NY (US)

( * ) Notice: Subject to any disclaimer, the term of this patent is extended or adjusted under 35 U.S.C. 154(b) by 0 days.

(21) Appl. No.: 09/352,525

(22) Filed: Jul. 13, 1999

(51) Int. Cl.[7] ..... B65D 85/00

(52) U.S. Cl. ..... 206/455; 206/232; 434/308

(58) Field of Search ..... 206/232, 455, 206/456, 579; 434/308; 281/29, 30, 31, 38; 402/70, 79

(56) References Cited

U.S. PATENT DOCUMENTS 4,255,872 * 3/1981 Williams, Sr. ..... 434/308
4,521,091 * 6/1985 Theslof, Jr. ..... 353/122
4,704,042 * 11/1987 Eisen et al. ..... 402/79
4,974,983 * 12/1990 Givati ..... 206/232
5,066,046 * 11/1991 Hoopingarner ..... 281/38
5,127,756 * 7/1992 Lumm ..... 402/79
5,431,449 * 7/1995 Arimoto et al. ..... 281/31
5,501,540 * 3/1996 Ho ..... 402/70
5,709,496 * 1/1998 Werner et al. ..... 402/79
6,059,317 * 5/2000 Wiley ..... 281/38

* cited by examiner

*Primary Examiner*—David T. Fidei
(74) *Attorney, Agent, or Firm*—McGlew and Tuttle, P.C.

(57) ABSTRACT

A slide presentation arrangement and method are provided. The presentation arrangement includes a slide sleeve sheet including a plurality of slide pockets each sized to receive a slide and at least one additional pocket. A plurality of slides are provided with each slide having a border with indicia for identifying the slide. A plurality of lecture note cards are also provided. Each lecture note card includes indicia presenting information for correlating the note card with a particular slide. Each lecture note card also includes graphics/indicia corresponding to the graphics/indicia of the corresponding slide and lecture notes for the corresponding slide. The slides are disposed in an order in a sleeve sheet and said note cards are disposed in an order in the additional pocket.

13 Claims, 3 Drawing Sheets

SLIDE PRESENTATION KIT, SLIDE PRESENTATION SYSTEM AND METHOD OF ORGANIZING INFORMATION FOR A SLIDE PRESENTATION

FIELD OF THE INVENTION

The invention relates generally to equipment for organizing slide presentations and/or lectures such as binders as well as slide sleeves for holding slides and literature or handouts.

BACKGROUND OF THE INVENTION

Slide presentations are frequently given wherein the person or group of people presenting the slide presentation is provided with information as well as slides. The person or group of people presenting the slide presentation must consider the information so as to prepare themselves for the presentation but must also remain organized keeping the slides in order and keeping notes, handout literature, etcetera on hand and in an organized matter.

Slide sleeves have been used in the past for protecting and holding slides. These sometimes have pockets formed of a plastic material whereby the slide may be slipped into the pocket for protecting the slide and for holding the slide. Such slide sleeves can be used along with a binder such as a three ring binder which holds one or more slide sleeve sheets. Typically one sheet can hold numerous slides.

Often presentations are made wherein the presentation is changed slightly, either from one day to the next or depending on the group which the presentation is being given to. It can be very difficult to change a slide presentation and change the notes and other material which are to be used by the presenter.

SUMMARY AND OBJECTS OF THE INVENTION

It is an object of the invention to provide a slide sleeve and information kit which holds and maintains organized a plurality of slides and a plurality of cards containing information associated with each of the slides. Preferably indicia is provided which indicates the association between each slide and each card and wherein the cards and slides are maintained organized and held in the organized state.

It is another object of the invention to provide a system for presentations which includes a slide sleeve sheet with a plurality of slide sleeves and a lecture note pocket with a plurality of lecture notes wherein each lecture note has a number or other indicia corresponding to a number or other indicia on each slide and wherein a plurality of slide sleeve sheets are provided in a binder to facilitate slide presentations.

It is still another object of the invention to provide a method for facilitating slide presentations which includes using a sheet having a plurality of slide sleeves and a lecture note sleeve, providing a plurality of slides each with a number and providing a plurality of lecture note cards, each with a number and positioning the slides in an order in these sleeves and positioning the cards in an order, in the sleeve.

According to the invention, a slide presentation materials assembly is provided including a slide sleeve sheet with a plurality of slide pockets each sized to receive a slide and at least one additional pocket. A plurality of slides are provided with each slide having a border with indicia for identifying the slide. A plurality of lecture note cards are also provided with each lecture note card including indicia presenting information for correlating the note card with a particular slide, graphics/indicia corresponding to the graphics/indicia of the corresponding slide, and lecture notes for the corresponding slide.

The sheet is a preferably a plastic sheet formed of a base sheet and at least one sheet for forming pockets with respect to said base sheet. The sheet may have a fold over portion including another pocket. A sleeve insert may be inserted into the another pocket. The fold over portion may be folded over the other portion of the slide sleeve sheet. A ring binder may also be provided wherein the slide sleeve sheet includes holes for connection to the ring binder.

The invention also includes a slide presentation and organization method including providing a slide sleeve sheet with a plurality of slide pockets each for receiving a slide and another pocket which is larger than said slide receiving pockets, preparing a plurality of slides, each slide having graphics/indicia, placing indicia on a margin of each slide to distinguish one slide from another, preparing a plurality of lecture note cards, each lecture note card including indicia corresponding to the indicia on one of the slides and including lecture notes, positioning the slides such that each slide is in one of the slide pockets and positioning the lecture note cards in the another pocket.

The lecture note cards are printed to each have a printed portion corresponding to the indicia/graphics of the corresponding slide. The step of providing a slide sleeve sheet may include providing a base sheet and welding additional sheets to the base sheet to form the plurality of slide pockets each slide pocket being sized to receive a slide and to form the additional pocket.

The invention also includes a system of organizing slides and other material and making a presentation based on the organized slides and other material.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
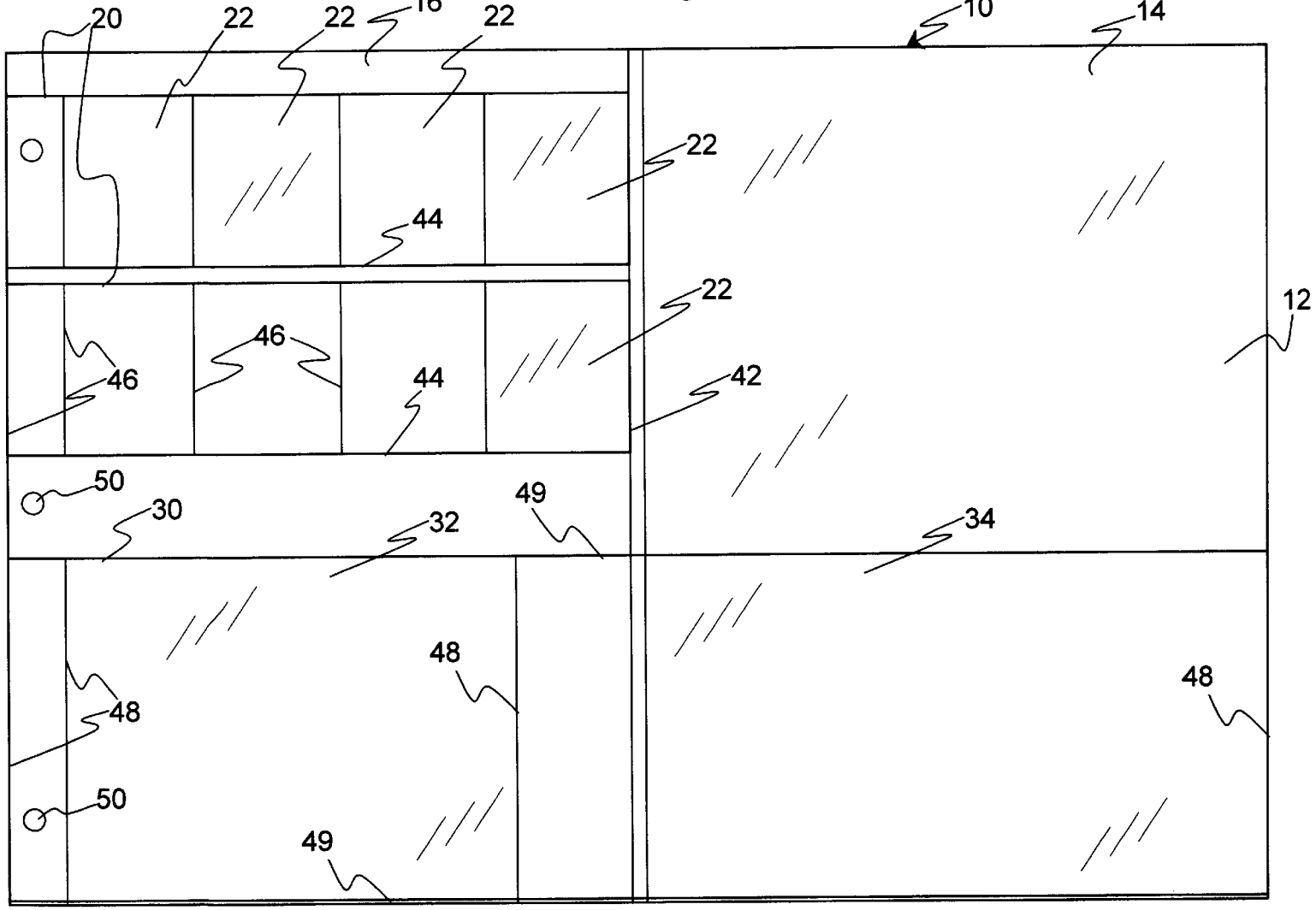
FIG. 1 is a view of a slide sleeve sheet according to the invention.

Referring to the drawings in particular, the invention comprises an arrangement or kit including complimentary items to facilitate slide presentations. As can be seen in FIG. 1, the kit includes a slide sleeve sheet generally designated 10. The sheet includes a plurality of slide sleeves 22 which are in the form of pockets for receiving a slide and holding the slide in the sheet 10 to facilitate organization of the slide presentation. The sheet 10 includes a base sheet 12 which defines the overall dimension of the sheet 10. Two pocket sheets 20 are provided which overly the base sheet 12. The sleeves 22 are formed by a plurality of vertical welds 46 for each sheet 20 and a base or bottom weld 44 for each of the sleeve sheets 20. The welds 44 and 46 cooperate to form the pockets or sleeves 22 and the welds 44 and 46 hold the pocket sheet 20 to the base sheet 12. Additionally, a sheet 30 is provided on the base sheet 12. The sheet 30 preferably extends from a left edge to a right edge of the base sheet 12 as viewed in FIG. 1. The sheet 30 is welded to the base sheet 12 at vertical welds 48 as well as a bottom or base weld 49. The welds 48 define a note card pocket 32. At the center of base sheet 12 a fold weld 42 is provided. Fold welds 42 provide the right most weld for the pockets 22 formed at the right end of the pocket sheet 20. Welds 42 also help define another pocket 34 in cooperation with a right most vertical weld 48. The fold welds 42 may be formed for example with two weld seams so as to provide a spine or spacing between a left side 16 of the sheet 10 and the right side 14 of the sheet 10. This allows the right side 14 of sheet 10 to be folded over on top of the left side 16 of the sheet 10. Such a fold weld 42 may also be provided by a pressing weld process wherein punctaform or localized weld spots are provided to form a spacing between the left side of sheet 10 and the right side of sheet 10 when the right side 14 of sheet 10 is folded over the left side 16 of sheet 10. In the embodiment of FIG. 1 a further horizontal weld 49 is provided to seal the portion of sheet 30 which is not to form a pocket. This may also be left open to store a pen or laser pointer or other item. At the very left edge of the sheet 10 holes 50 are provided such that the sheet 10 may be bound in a three ring binder or similar type structure. The dimension from the holes 50 to the fold well 42 is preferably greater than the distance from the fold weld 42 to the rightmost edge of the sheet 10 (to facilitate the folding over of the rightmost portion 16 of the sheet 10 over the leftmost portion 14 of the sheet 10).

Figure 2:
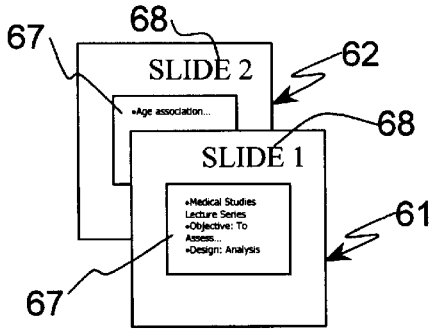
FIG. 2 is a view showing a plurality of slides according to the invention.

FIG. 2 shows slides according to the invention wherein a plurality of slides 61, 62, 63, etcetera are provided. Each slide includes a slide graphics portion 67 (this may be indicia, symbols, photographs or a mixture of graphics, symbols, photos, etcetera). Additionally, each slide includes a margin region with indicia 68. According to the preferred embodiment, the indicia 68 is a simple number or a combination of a number, letters or words.

Figure 3:
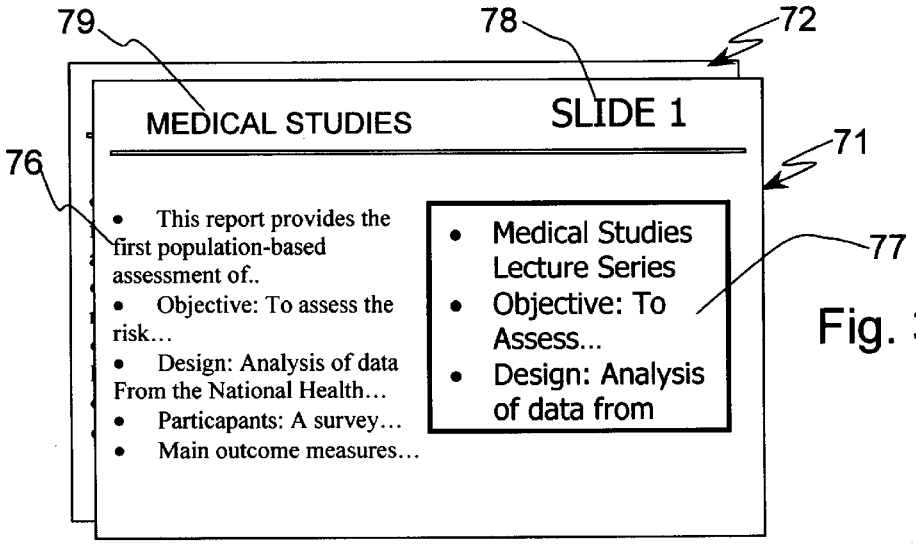
FIG. 3 is a view of showing a plurality of lecture note cards according to the invention.

FIG. 3 shows a note card according to the invention. The note card 71 is a lecture note for use by the person giving the presentation. Other lecture notes, 72, 73, etcetera may also be provided. Each lecture note card 71 includes indicia 78 which corresponds in some way with the indicia 68 on a corresponding slide such as slide 61. The indicia 78 may be a number, letters or a combinations of numbers, letters and/or words. The note card also includes a reproduction of the slide in the form of the graphic/indicia 77. Lecture notes 76 are provided on the card 71 and preferably a title or topic indicia 79 is also provided on the card 71.

Figure 4:
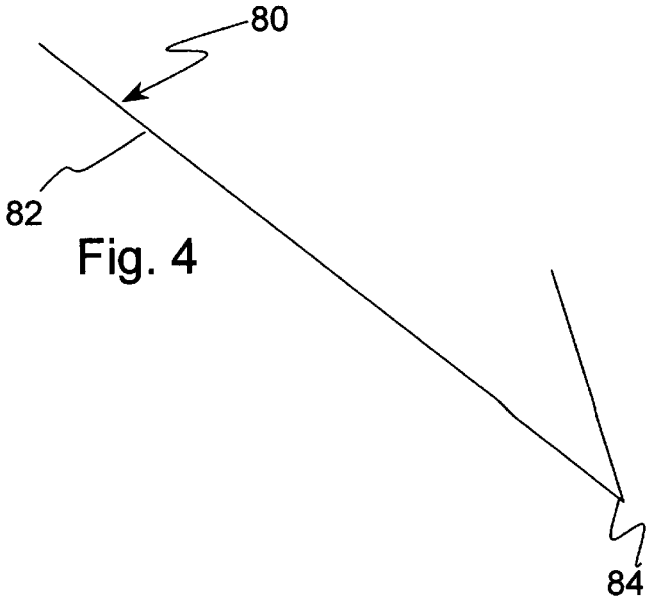
FIG. 4 is a side view of an insert with indicia and providing a pocket for holding data sheets or handouts.
Figure 6:
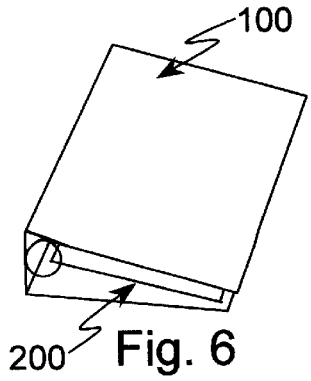
FIG. 6 is a schematic view showing a binder holding the arrangement of FIG. 5

FIG. 4 shows a side view of a sleeve insert 80. Sleeve insert 80 preferably has indicia such as written text on a lower front side 83 and preferably also has indicia such as written text on a rear side 82. The sleeve insert 80 is preferably put into pocket 34 on the right hand side of sheet 10. The indicia at side 82 is visible as the right side of sheet 10 is folded over the left side of sheet 10. General information as to the presentation is preferably provided on the side 82. Additionally, further summary notes or other key points or key information is provided on the side 83. This information on side 83 is visible through sheet 30 when the sleeve insert 80 is positioned in pocket 34. The sleeve insert 80 also provides a convenient feature for receiving data sheets or handouts. The sleeve 80 makes it easier to insert and withdraw such data sheets or handouts and prevents a static cling of the handout to the sheet 12 or sheet 30 of the slide sleeve sheet 10.

Figure 5:
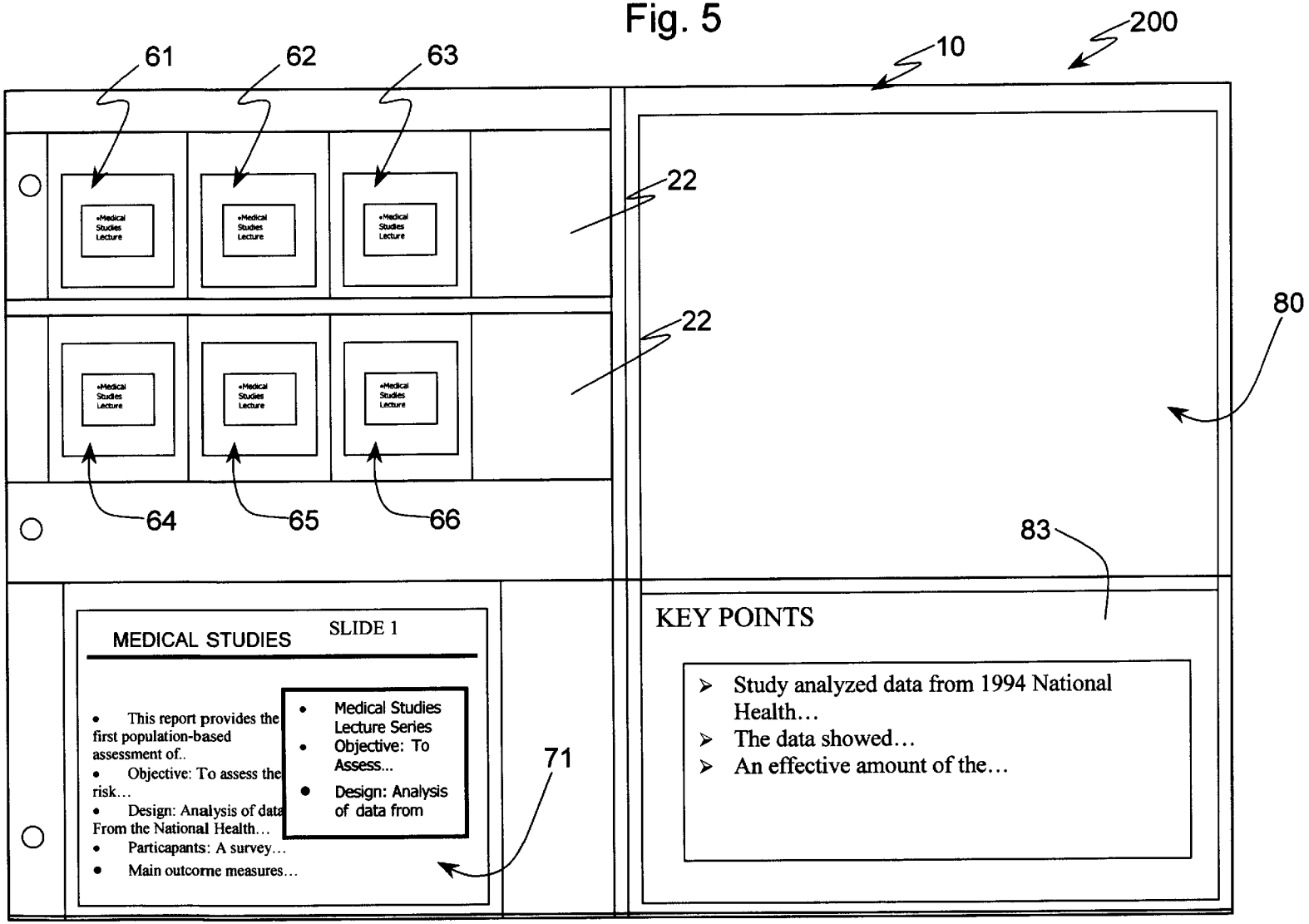
FIG. 5 is a view similar to FIG. 1 showing elements of a kit provided together including the slide sleeve sheet of FIG. 1.

FIG. 5 shows the various components of the kit in an assembled state, ready to be placed in a binder 100. Several slides 61, 62, 63, 64, 65 and 66 are placed in the sleeve pockets 22. Each of the slides 62 through 66 has features similar to slide 61 discussed above, mainly it includes indicia 68 corresponding to indicia 78 on a relating or corresponding lecture note card 71. Each slide further includes the slide or graphics material 67 which is used with a projector or other convenient slide showing device. A plurality of cards 71, 72, etcetera are disposed in pocket 32. Further, a sleeve insert 80 is disposed in pocket 34. One or more sleeve sheets 10 are provided in a binder with each sleeve sheets 10 having one or more slides with one or more corresponding lecture note cards 71.

The system of the invention includes the slide sleeve sheet 10 as described above along with a plurality of slides 61–66 and a plurality of corresponding lecture note cards 71, 72, etcetera, as described above. The system preferably also includes a sleeve insert 80 with indicia corresponding to the particular slide presentation including key points at the front flap side 83 and general information as to the presentation on the rear side 82 (which becomes the cover when the right side 14 is folded over the left side 16), in a closed state and the entire assembly is placed in a binder. Preferably one or more data sheets or handouts are provided in sleeve insert 80, within pocket 34.

The method of the invention includes welding sheets 20 and 30 onto a base sheet 12 including providing horizontal welds 44 and 49, and providing vertical welds 46, 48 as well as 42. A further optional horizontal weld 49 can be provided. By providing the various welds as seen in FIG. 1 a plurality of pockets or slide sleeves 22 are provided which pockets are open at the top allowing a slide to be slipped between base sheet 12 and the pocket sheet 20. Additionally and opening is provided at a top of a pocket 32 formed by the various welds 48 and 49. A lecture note card may be inserted in the opening of the pocket 32 and preferably a plurality of lecture note cards may be held in this pocket. In a similar manner pocket 34 is formed with an upper opening based on the base weld 49, the fold weld 42 and the rightmost vertical weld 48.

A plurality of slides 61, 62, 63, etcetera are prepared including a picture/graphics/indicia part 67 which is formed in a known manner. A border or frame part of the slide is provided and indicia 68 is added, wherein each slide 61, 62, 63, etcetera has indicia 68 which is different from the other slide, so as to distinguish one slide from the other.

The lecture note card 71 is provided corresponding to slide 61 and further lecture note card 72, 73, etcetera are provided. Each lecture note card 71,72, etcetera is printed with a slide box 77 which basically includes the same indicia/graphics/photos etcetera as does the corresponding slide 61, 62, 63, etcetera. Additionally, each lecture note card is printed with a general or topic indicia 79 and specific lecture notes 76. The note cards 71, 72, etcetera may be of card board or other suitable material, including paper.

A sleeve insert is also printed on a paper or card board element which is printed on one side and folded at fold 84 to provide printed parts 83 and 82. Printed part 83 is preferably provided with key points or other information relating to the slide presentation. Printed side 82 is preferably provided with general information regarding the presentation or regarding the page of the presentation (e.g. if several sheets 10 are used for one presentation side 82 may be used to indicate an order of sheets 10). Typical information on side 82 may also include a date and title of the presentation along with a sheet page number etcetera.

The slide 61, 62, etcetera are inserted in an order in pocket 62 and lecture cards 71, 72, 73, etcetera are inserted in pocket 32 in an order which corresponds generally to an order of the slides in pockets 22. The sleeve insert 80 is disposed in pocket 34 and additionally handouts or other material may also be disposed in pocket 34. The sheet 10 is placed in a binder using holes 50. The right side 14 of sheet 10 is then folded over the left side 16 of sheet 10. Additional sheets 10 may be provided with further slides and further lecture cards either associated with the same lecture (wherein the sheets 10 are numbered, preferably by providing numbers at indicia surface 82 or sheets 10 are used for additional presentations and maintained in the same binder).

While a specific embodiment of the invention has been shown and described in detail to illustrate the application of the principles of the invention, it will be understood that the invention may be embodied otherwise without departing from such principles.

What is claimed is:

1. A slide presentation materials assembly, comprising:

a slide sleeve sheet including a plurality of slide pockets each sized to receive a slide and at least one additional pocket;

a plurality of slides, each slide having a border with indicia for identifying the slide and having slide graphics/indicia comprising the content of the slide; and a plurality of lecture note display surfaces, each of said lecture note display surfaces including indicia presenting information for correlating the note display surfaces with a particular slide based on said indicia of said border, graphics/indicia corresponding to the graphics/indicia of the corresponding slide, and lecture notes for the corresponding slide, said plurality of lecture note display surfaces being disposed together in said additional pocket.

2. The slide presentation assembly according to claim 1 wherein said sheet is a plastic sheet formed of a base sheet and at least one sheet for forming pockets with respect to said base sheet.

3. The assembly according to claim 1, further comprising a fold over portion, said fold over portion including another pocket; and a sleeve insert inserted into said another pocket.

4. The assembly according to claim 1, further comprising a ring binder, wherein said slide sleeve sheet includes holes for connection to said ring binder.

5. A slide presentation and organization method comprising the steps of:

providing a slide sleeve sheet including a plurality of slide pockets each for receiving a slide and another pocket which is larger than said slide receiving pockets;

preparing a plurality of slides, each slide having display graphics/indicia surrounded by a slide margin portion;

placing indicia on said slide margin portion of each slide to distinguish one slide from another;

preparing a plurality of lecture note display surfaces, each of said lecture note display surfaces including indicia corresponding to the indicia on said slide margin portion of one of said slides and including lecture notes and including printed portion display graphics/indicia corresponding to said display graphics/indicia of said one of said slides;

positioning the slides such that each slide is in one of said slide pockets; and positioning the lecture note display surfaces in said another pocket.

6. The method according to claim 5, wherein said step of providing a slide sleeve sheet includes providing a base sheet and welding additional sheets to the base sheet to form a plurality of said slide pockets each slide pocket being sized to receive a slide and to form the additional pocket.

7. The method according to claim 5, wherein said sheet is a plastic sheet formed of a base sheet and at least one sheet for forming pockets with respect to said base sheet.

8. The method according to claim 5, further comprising:

forming said slide sheet with a fold over portion, said fold over portion including another pocket;

inserting a sleeve insert into said fold over portion another pocket.

9. The method according to claim 5, further comprising providing a ring binder, providing holes in said slide sleeve for connection to said ring binder.

10. A slide organization system, comprised:

a slide sleeve sheet including a plurality of slide pockets each sized to receive a slide and at least one additional pocket;

a plurality of slides, each slide having display indicia/graphics and a border with indicia for identifying the slide; and a plurality of lecture note cards, each lecture note card including indicia presenting information for correlating the note card with a particular slide, graphics/indicia corresponding to said display graphics/indicia of the corresponding slide, and lecture notes for the corresponding slide, the slides being disposed in an order in said sleeve sheet and said note cards being disposed in an order in said additional pocket.

11. The system according to claim 10 wherein said sheet is a plastic sheet formed of a base sheet and at least one sheet for forming pockets with respect to said base sheet.

12. The system according to claim 10, further comprising a fold over, said fold over portion including another pocket; and a sleeve insert inserted into said another pocket.

13. The system according to claim 10, further comprising a ring binder, wherein said slide sleeve sheet includes holes for connection to said ring binder.

* * * * *